US008840398B2

(12) United States Patent
Lee

(10) Patent No.: US 8,840,398 B2
(45) Date of Patent: Sep. 23, 2014

(54) GAS LIGHTER WITH ROLLER-ROTATION RESTRAINING PART

(76) Inventor: Ki Chol Lee, Seoul (KR)

( * ) Notice: Subject to any disclaimer, the term of this patent is extended or adjusted under 35 U.S.C. 154(b) by 212 days.

(21) Appl. No.: 13/366,171

(22) Filed: Feb. 3, 2012

(65) Prior Publication Data

US 2012/0251961 A1 Oct. 4, 2012

(30) Foreign Application Priority Data

Apr. 4, 2011 (KR) ..... 20-2011-0002779

(51) Int. Cl.

| | |
|---|---|
| ***F23Q 2/46*** | (2006.01) |
| ***F23Q 2/50*** | (2006.01) |
| ***F23Q 1/02*** | (2006.01) |
| ***F23Q 2/16*** | (2006.01) |

(52) U.S. Cl.
CPC ..... *F23Q 2/164* (2013.01)
USPC ..... 431/274; 431/137; 431/139; 431/269

(58) Field of Classification Search
CPC ..... F23Q 2/34
USPC ..... 431/133–143, 267–277
See application file for complete search history.

(56) References Cited

U.S. PATENT DOCUMENTS

| | | | | | |
|---|---|---|---|---|---|
| 2,002,845 | A * | 5/1935 | Aronson | 431/140 |
| 2,438,727 | A * | 3/1948 | Troubh | 431/275 |
| 3,154,936 | A * | 11/1964 | Primich et al. | 431/276 |
| 3,506,387 | A * | 4/1970 | Dupont | 431/275 |
| 3,827,852 | A * | 8/1974 | Chevallier | 431/254 |
| 4,146,358 | A * | 3/1979 | Dixon | 431/274 |
| 5,120,216 | A * | 6/1992 | Iwahori | 431/254 |
| 5,358,401 | A * | 10/1994 | Iwahori et al. | 431/277 |
| 5,743,725 | A * | 4/1998 | Chan | 431/153 |
| 6,612,831 | B1 * | 9/2003 | Ansquer et al. | 431/153 |
| 6,716,024 | B2 * | 4/2004 | Jon | 431/153 |
| 6,786,715 | B1 * | 9/2004 | Saito | 431/153 |
| 6,837,705 | B2 * | 1/2005 | Sewalt | 431/153 |
| 2009/0286192 | A1 * | 11/2009 | Ochiai | 431/253 |

FOREIGN PATENT DOCUMENTS

| | | | | |
|---|---|---|---|---|
| JP | 2001-153358 | A | 6/2001 | |
| JP | 2005-77061 | A | 3/2005 | |
| KR | 2003-0018251 | A | 3/2003 | |
| KR | 10-0711582 | B1 | 4/2007 | |
| WO | WO 2005024304 | A1 * | 3/2005 | F23Q 2/34 |

OTHER PUBLICATIONS

Grant Hagedorn, The Power of Sheet Metal Design, Feb. 25, 2011, The Fabricator.com, www.thefabricator.com.*

* cited by examiner

*Primary Examiner* — Steven B McAllister
*Assistant Examiner* — Rabeeul Zuberi
(74) *Attorney, Agent, or Firm* — Christensen O'Connor Johnson Kindness PLLC

(57) ABSTRACT

The present invention relates to a gas lighter with a roller-rotation restraining part, extending toward a roller from one side of a top surface of a cap for surrounding a nozzle of the gas lighter so that the roller-rotation restraining part is caught by and brought in contact with the roller. Thus, a certain rotation-restraining force is added to the rotation of the roller by means of the roller-rotation restraining part which is caught by and brought in contact with the roller during the rotation of the roller for ignition to increase a finger grasp force required for the ignition of the gas lighter through the rotation of the roller, thereby being capable of preventing an accident, should the lighter get into the hands of a child.

9 Claims, 10 Drawing Sheets

(a)

(b)

GAS LIGHTER WITH ROLLER-ROTATION RESTRAINING PART

BACKGROUND OF THE INVENTION

1. Field of the Invention

The present invention relates to a gas lighter with a roller-rotation restraining part, and more particularly, to a gas lighter with a roller-rotation restraining part, wherein the roller-rotation restraining part extends toward a roller from one side of a top surface of a cap for surrounding a nozzle of the gas lighter so that the roller-rotation restraining part is caught to and brought in contact with the roller, and thus, a certain rotation-restraining force is added to the rotation of the roller by means of the roller-rotation restraining part which is caught to and brought in contact with the roller during the rotation of the roller for ignition to increase a finger grasp force required for the ignition of the gas lighter through the rotation of the roller, thereby being capable of preventing an accident of the gas lighter which could be resulted from children.

2. Description of the Related Art

A gas lighter may be conveniently used in our daily lives, and it has been generally made as a disposable or rechargeable gas lighter. Since the disposable gas lighters which are relatively cheap among others are provided free as sales promotion gifts in restaurants, drinking bars, and the like, there may be commonly a plurality of gas lighters in the majority of houses.

As shown in FIGS. 1 and 2, a conventional gas lighter which has been generally used includes a tank 10 for storing a gas; a nozzle 20 for spraying the gas in the tank 10; a lever 30 for opening and closing the nozzle 20; a lighter flint 40 installed adjacent to the nozzle 20; a roller 50 which is rubbed with the lighter flint 40 to cause the gas sprayed from the nozzle 20 to be ignited; a cap 60 for surrounding the nozzle 20, which is provided with a flame discharge hole 61 through which an ignited flame is discharged.

The conventional gas lighter so constructed operates in such a manner that an outer surface of the roller 50 may be rubbed with the lighter flint 40 by rotating the roller 50, so that a spark may be generated at the lighter flint 40, and simultaneously, the lever 30 is pushed down to open the nozzle 20 so that a liquefied petroleum gas which has been stored in the tank 10 may be sprayed through the nozzle 20 in a vaporized state, thereby capable of igniting the gas lighter by means of the spark generated at the lighter flint 40. Thus, the conventional gas lighter may be ignited only with a simple operation in which a thumb or the like is used to rotate the roller 50 while simultaneously pushing down the lever 30.

That is, since the conventional gas lighter may be easily ignited by rotating the roller even with a relatively small force through the simple operation, if a child inadvertently rotates the roller of the gas lighter, a flame may be generated due to the rubbing between the lighter flint and the roller and the nozzle may be opened, thereby resulting in inadvertent ignition. Thus, there has been a problem in that it is difficult to prevent negligent accidents and fire hazards due to the conventional gas lighter.

That is, since even a child of about 4 or 5 years of old may ignite the conventional gas lighter, if the gas lighter is ignited while a fire-curious child plays with the gas lighter, there is a risk in that an inadvertent accident such as fires may be taken place.

The Safety Standard for Cigarette Lighters, Requirements for Child Resistance provided by the United States Consumer Product Safety Commission (CPSC) in 1995 has to release in the market only a gas lighter with a means for preventing the use by children, which has an effect on reducing negligent accidents which might be generated during children's playing with the gas lighter. Other developed countries in addition to the United States also have established similar regulations so that they have attempted to reduce the children's accidents due to the gas lighter.

Accordingly, research and development has been conducted regarding a safer gas lighter, which is difficult for a child, having a relatively small finger strength relative to an adult, to operate. One goal in this regard is to protect children from fire hazards caused by gas lighters.

SUMMARY OF THE INVENTION

Accordingly, the present invention is conceived to solve the aforementioned problems. An object of the present invention is to provide a gas lighter with a roller-rotation restraining part, wherein the roller-rotation restraining part extends toward a roller from one side of a top surface of a cap for surrounding a nozzle of the gas lighter so that the roller-rotation restraining part is caught to and brought in contact with the roller, and thus, a certain rotation-restraining force is added to the rotation of the roller by means of the roller-rotation restraining part which is caught to and brought in contact with the roller during the rotation of the roller for ignition to increase a finger grasp force required for the ignition of the gas lighter through the rotation of the roller, thereby being capable of preventing an accident of the gas lighter which could be resulted from children.

According to the present invention for achieving the objects, there is provided a gas lighter with a roller-rotation restraining part, which comprises a tank for storing a gas; a nozzle for spraying the gas in the tank; a lever for opening and closing the nozzle; a lighter flint installed adjacent to the nozzle; a roller including a spark wheel and a pair of side wheels, the spark wheel being rubbed with the lighter flint to cause the gas sprayed from the nozzle to be ignited, the side wheels being formed on both sides of the spark wheel, respectively, the side wheel having a plurality of operating saw teeth formed around an outer peripheral surface thereof; and a cap surrounding the nozzle, the cap being formed with a flame discharge hole through which an ignited flame is discharged, wherein the cap is provided with a roller-rotation restraining part at a top surface thereof, and the roller-rotation restraining part extends to be bent from one side of the top surface of the cap toward the roller, so that an extending distal end of the roller-rotation restraining part is caught by and brought in contact with the roller, thereby adding a certain rotation-restraining force to the roller during the rotation of the roller for ignition.

Accordingly, the certain rotation-restraining force are added to the rotation of the roller by means of the roller-rotation restraining part which is caught to and brought in contact with the roller during the rotation of the roller for ignition, thereby increasing the finger grasp force required for the ignition of the gas lighter through the rotation of the roller. As such, it is substantially difficult for a child having a relatively smaller finger grasp force than an adult to ignite the gas lighter, thereby being capable of protect children from fire hazards due to the gas lighter.

DESCRIPTION OF THE PREFERRED EMBODIMENT

Figure 1:
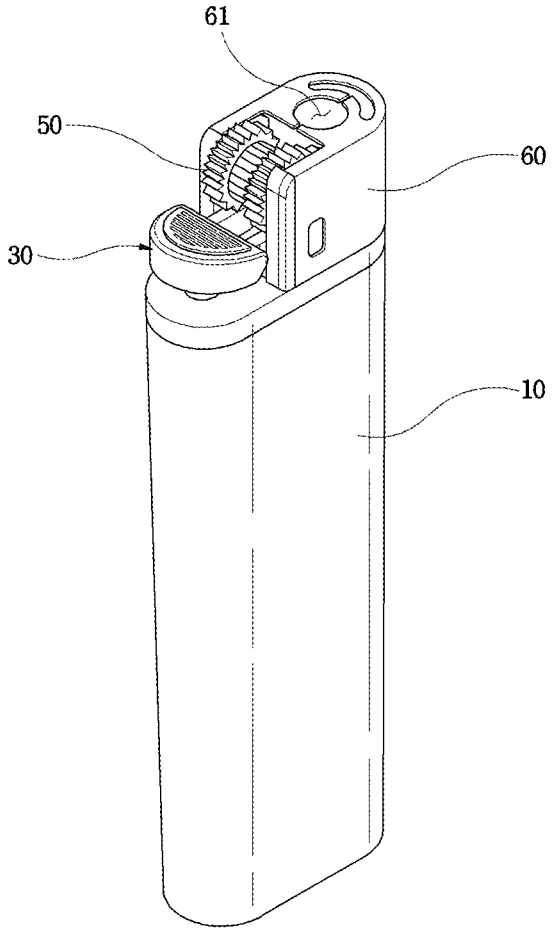
FIG.1 (PRIOR ART)
FIGS. 1 and 2 are views illustrating the configuration of a conventional gas lighter.
Figure 2:
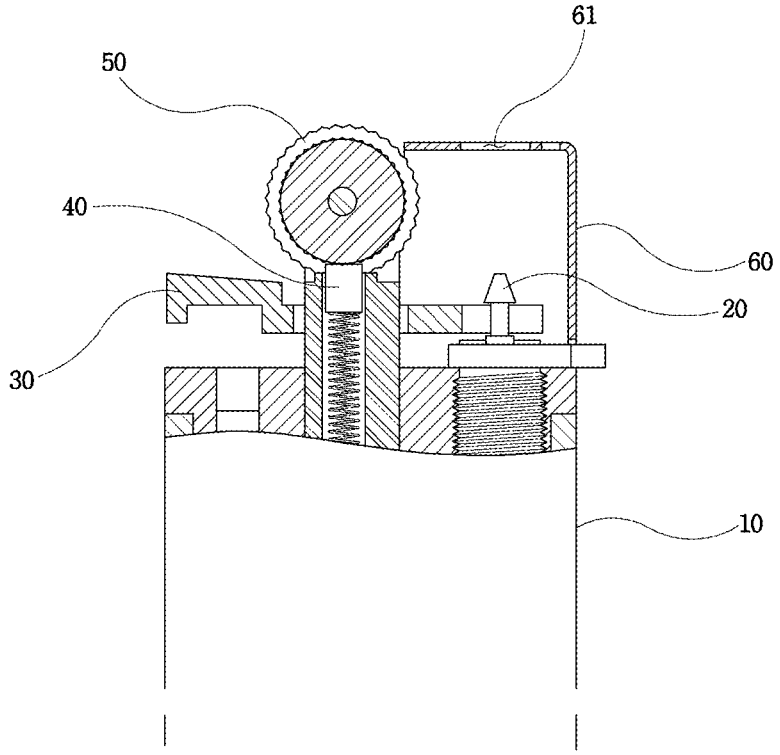
FIG.2 (PRIOR ART)

Hereinafter, although embodiments of the present invention will be described in detail, the present invention is not limited to the following embodiments as long as they do not depart from the scope of the invention.

Prior to the description, a first embodiment will be representatively described using the same reference numerals for elements having the same configuration in a variety of embodiments, and in the other embodiments, only the elements other than those of the first embodiment will be described.

Figure 3:
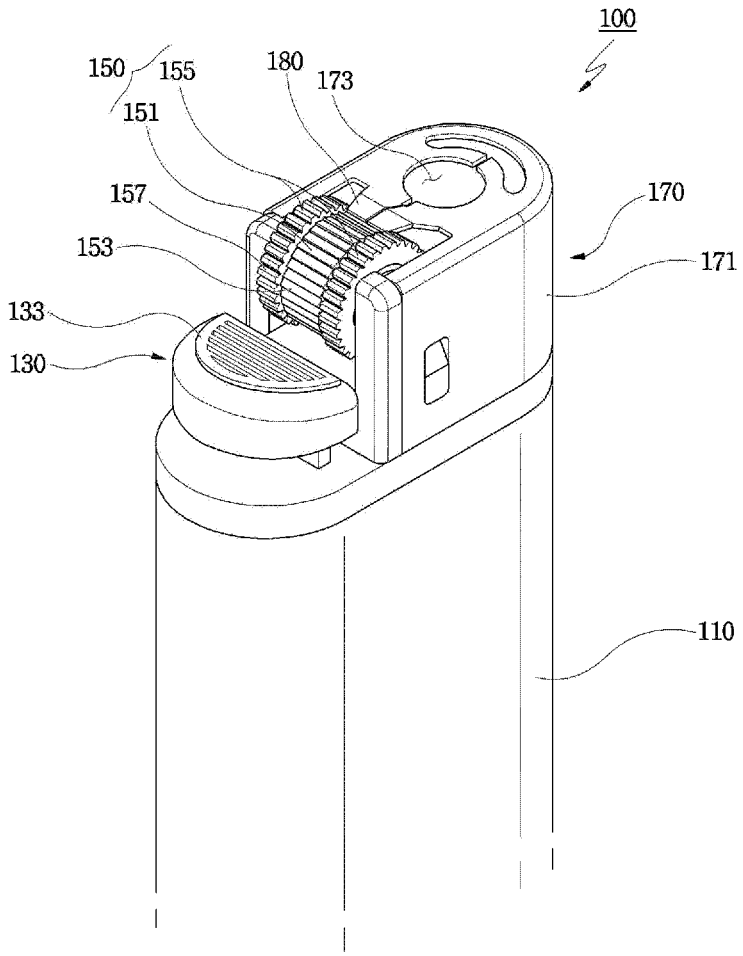
FIG. 3 is an entire perspective view illustrating a gas lighter with a roller-rotation to restraining part according to a first embodiment of the present invention.
Figure 4:
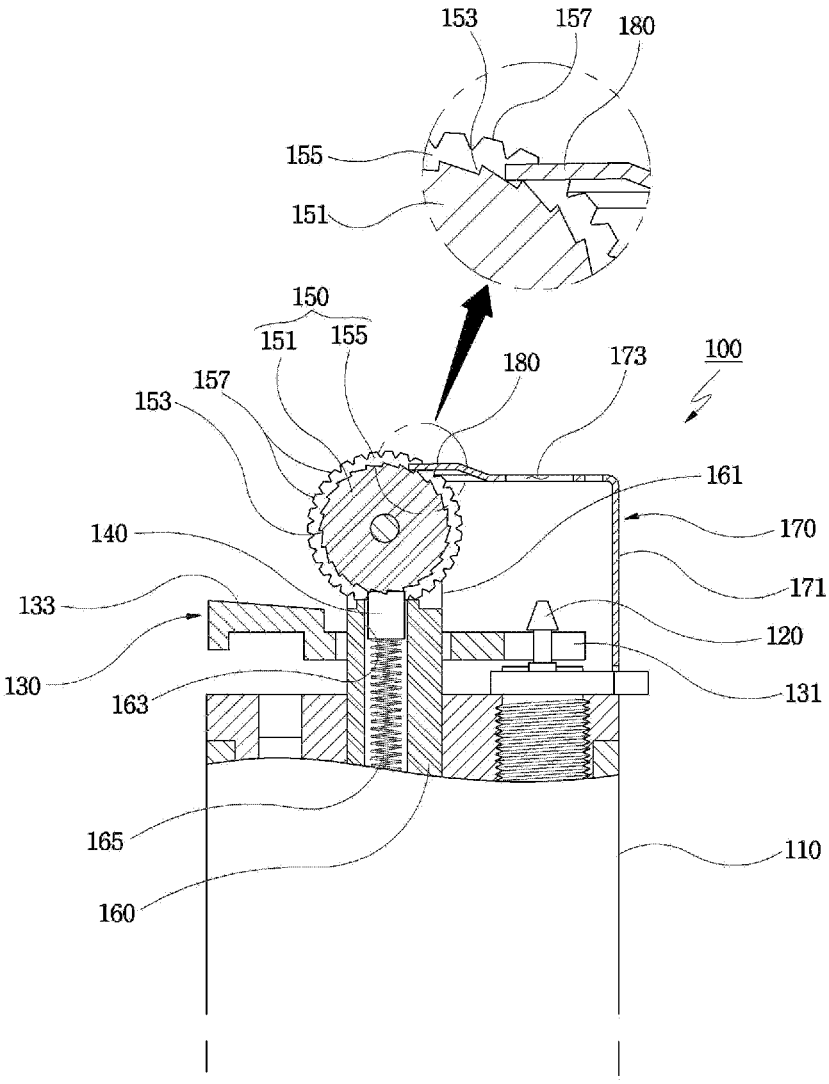
FIG. 4 is a side sectional view illustrating the configuration of the gas lighter with the roller-rotation restraining part shown in FIG. 3.
Figure 5:
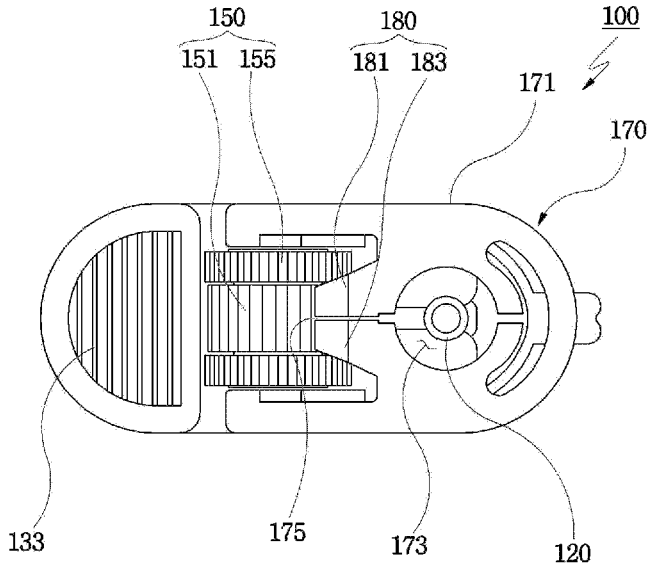
FIG. 5 is a plan view illustrating the configuration of the gas lighter with the roller-rotation restraining part shown in FIG. 3.

FIG. 3 is an entire perspective view illustrating a gas lighter with a roller-rotation restraining part according to a first embodiment of the present invention, FIG. 4 is a side sectional view illustrating the configuration of the gas lighter with the roller-rotation restraining part shown in FIG. 3, and FIG. 5 is a plan view illustrating the configuration of the gas lighter with the roller-rotation restraining part shown in FIG. 3.

Referring to FIGS. 3 to 5, a gas lighter 100 with a roller-rotation restraining part according to the first embodiment of the present invention includes a tank 110 for storing a gas; a nozzle 120 for spraying the gas from the tank 110; a lever 130 for opening and closing the nozzle 120; a lighter flint 140 installed adjacent to the nozzle 120; a roller 150 having a spark wheel 151, which is rubbed with the lighter flint 140 to cause the gas sprayed from the nozzle 120 to be ignited, and a pair of side wheels 155, which are provided on both sides of the spark wheel 151, respectively; a cap 170 installed on a top portion of the tank 110 to surround the nozzle 120, wherein the cap is provided with a roller-rotation restraining part 180 which extends from one side of a top surface of the cap toward the roller 150 so that an end of the roller-rotation restraining part is caught to and brought in contact with one of grooves 153 formed on the spark wheel 151 of the roller 150, thereby adding a certain rotation-restraining force to the roller 150 during the rotation of the roller 150 for ignition.

That is, in order that it is difficult for a child to operate the gas lighter, the gas lighter according to the present invention has the roller-rotation restraining part provided at the cap of the gas lighter, wherein the roller-rotation restraining part is caught to and brought in contact with the spark wheel of the roller, so that a force larger than a predetermined amount is required to rotate the roller for causing the ignition. Therefore, if the roller is rotated for the ignition, a constant rotation restraining force is added to the rotation of the roller as the roller is rotated with the roller-rotation restraining part being caught to and brought in contact with the groove formed around the spark wheel. As such, only if the roller is rotated by using a finger grasp force larger than the rotation restraining force, the gas lighter may be ignited.

Each component of the gas lighter 100 with the roller-rotation restraining part 180 will be described. The tank 110 is filled with a liquefied petroleum gas as an ignition fuel of the gas lighter, and the nozzle 120 for spraying the liquefied petroleum gas into a vaporized gas is positioned at a side of the top portion of the tank 110.

A support 160 having a roller support 161 and a lighter flint mount 163 is installed to a center of the top portion of the tank 110. The roller 150 is rotatably coupled to the roller support 161, and the lighter flint 140 is elastically supported to the lighter flint mount 163 by means of a spring 165 so that a top end of the lighter flint 140 is installed to be in contact with a lower outer peripheral surface of the roller 150.

Here, the roller 150 includes the spark wheel 151 which has a plurality of grooves 153 formed around an outer peripheral surface thereof to cause rubbing with the lighter flint 140, and a pair of side wheels 155 which are respectively provided on both sides of the spark wheel 151 and have a plurality of operating saw teeth 157 formed around an outer peripheral surface of each side wheel.

That is, the aforementioned side wheels 155 are provided coaxially on both sides of the spark wheel 151, respectively. Such side wheels 155 have a diameter larger than that of the spark wheel 151 so that the side wheels 155 may be easily in close contact with a user's finger. The operating saw teeth 157 are formed around the outer peripheral surface of each side wheel 155.

The operating saw teeth 157 formed around the outer peripheral surface of the side wheel 155 serve to increase a contact and frictional force between the user's finger and the side wheels 155 so that the user may easily rotate the side wheels 155.

With such a configuration, if the user brings a finger into close contact with the roller 150 in order to ignite the gas lighter 100, the finger comes into close contact with the pair of side wheels 155 which have a diameter larger than that of the spark wheel 151. As the user exerts the finger grasp force to rotate the side wheels 155, the spark wheel 151 provided between the pair of side wheels 155 is rotated so that the spark wheel 151 is rubbed with the lighter flint 140 to thereby generate a spark required for ignition.

The lever 130 is movably coupled to a top portion of the support 160, wherein one side of the lever 130 is provided with a coupling portion 131 which is coupled with the nozzle 120, and the other side of the lever 130 opposite to the coupling portion 131 with respect to the roller 150 is provided with a push plate 133.

That is, the lever 130 is arranged to be easily pushed down by the user immediately after the roller 150 is rotated by the force of the user exerted on the roller 150. Once the user pushes down the push plate 133 of the lever 130, the lever principle causes the coupling portion 131 of the lever 130 to lift up and open the nozzle 120, so that the gas is sprayed through the nozzle 120.

On top of the tank 110 is provided the cap 170 having a cap body 171 for surrounding the nozzle 120 and the roller-rotation restraining part 180 which extends from the cap body 171 toward the spark wheel 151 of the roller 150 so that an end of the roller-rotation restraining part 180 is caught to and brought in contact with the groove 153 of the spark wheel 151.

The cap body 171 serves as a wind shield to prevent a flame from being extinguished by a wind when a gas ejected from the nozzle 120 is ignited, and a top surface of the cap body 171 opposite to the nozzle 120 is provided with a flame discharge hole 173 through which an ignited flame is discharged from the nozzle 120.

As shown in FIG. 4, the roller-rotation restraining part 180 extends to be bent from one side of the top surface of the cap body 171 toward a top portion of the roller 150, thereby being caught to and brought in contact with the groove 153 of the spark wheel 151 in the roller 150.

That is, the roller-rotation restraining part 180 is formed to have a width corresponding to that of the spark wheel 151, so that the distal end of the roller-rotation restraining part 180 is caught to and brought in contact with the groove 153 formed on the spark wheel 151.

With such a configuration, when the user rotates the roller 150 to ignite the gas lighter, the spark wheel 151 is rotated with the roller-rotation restraining part 180 being caught to and brought in contact with the groove 153 formed around the spark wheel 151 so that the roller-rotation restraining part 180 causes a constant rotation restraining force to act on the spark wheel 151. As such, only if the roller 150 is rotated by using a finger grasp force larger than the rotation restraining force exerted on the roller 150, the gas lighter 100 can be ignited.

The cap 170 including the cap body 171 and the roller-rotation restraining part 180 as described above is generally made of a cold-drawn steel plate. Since the cold-drawn steel plate has a predetermined rigidity, when the user rotates the roller 150 to ignite the gas lighter 100, the spark wheel 151 is rotated with the roller-rotation restraining part 180 being caught to and brought in contact with the groove 153 formed around the spark wheel 151, so that the rotational force may cause the roller-rotation restraining part 180 to be lifted up due to the contact of the roller-rotation restraining part 180 with a protruding portion between two adjacent grooves 153 of the spark wheel 151 and the restoring force causes the roller-rotation restraining part 180 to be caught to and brought in contact with the next groove 153, thereby interrupting the rotation of the roller 150.

That is, as shown in FIG. 4, if the roller 150 is rotated to ignite the gas lighter with the roller-rotation restraining part 180 being caught to and brought in contact with the groove 153 formed around the spark wheel 151, the protruding portion between two adjacent grooves 153 of the spark wheel 151 presses a lower surface of the roller-rotation restraining part 180 while the plurality of grooves 153 are rotated around an axial center of the spark wheel 151, so that the roller-rotation restraining part 180 is lifted up and subsequently the lifted roller-rotation restraining part 180 is restored due to the restoring force to be caught to and brought in contact with its next groove 153. By repeating the process described above, a load is exerted on the roller-rotation restraining part 180, so that a certain rotation-restraining force is exerted on the rotation of the roller 150.

As described above, as the roller-rotation restraining part 180 is caught to and brought in contact with the groove 153 formed around the spark wheel 151, the rotation-restraining force generated during the rotation of the roller 150 may prevent a child having a relatively smaller finger grasp force than an adult from rotating the roller 150. On the other hand, the rotation restraining force is generated in a range in which the adult having a relatively larger finger grasp force may rotate the roller 150 in a relatively easy manner.

That is, even a relatively smaller force ranging from 1 to 2 kgf may be enough to rotate the roller in the conventional gas lighter without the configuration for restraining the rotation of the roller, so that even a child having a relatively smaller finger grasp force can easily ignite the conventional gas lighter. However, according to the gas lighter 100 with the roller-rotation restraining part of the present invention, when the roller 150 is rotated, the roller-rotation restraining part 180 which is caught to and brought in contact with the groove 153 formed around the spark wheel 151 results in the certain rotation-restraining force over the rotation of the roller 150, so that a relatively larger force, such as about 4 kgf or more, is required in order to exert on the roller 150 a rotational force sufficient to generate a spark between the spark wheel 151 and the lighter flint 140 to ignite the gas lighter 100. Accordingly, it is substantially difficult for a child having a relatively smaller finger grasp force to rotate the roller to ignite the gas lighter, thereby being capable of preventing an accident of the gas lighter which could be result from children.

Additionally, as shown in FIG. 4, the roller-rotation restraining part 180 provided in the cap 170 is in contact with a top portion of the spark wheel 151 and thus serves to prevent the spark wheel 151 from escaping.

That is, if the gas lighter is ignited and then the ignition state continues, the ignited flame may cause a peripheral portion of the nozzle 120 to be heated. In this case, the roller 150 arranged adjacent to the nozzle 120 and the roller support 161 supporting the roller 150 are directly heated. Here, since the roller support 161 is made of a plastic material, the roller support 161 may be melted if it is heated for a long time. If the roller support 161 is damaged due to the heat, an accident may take place in which the elastic force of the spring 165 provided under the roller support 161 causes the roller 150 and the lighter flint 140 to escape from the roller support 161 and to be jumped to the outside.

In this case, the gas lighter 100 with the roller-rotation restraining part according to the present invention is configured to have a structure in which the roller-rotation restraining part 180 of the cap 170 is in contact with the top portion of the roller 150 to fix the location of the roller 150. Accordingly, even if the ignition state continues for a long time and the roller support 161 is partially damaged, the location of the roller 150 is fixed by means of the roller-rotation restraining part 180, so that the roller 150 may be prevented from escaping from the roller support 161.

Further, when the cap 170 as described above is manufactured, an assembling slot 175 is formed along a central portion of the top surface of the cap 170 from the flame discharge hole 173 to the distal end of the roller-rotation restraining part 180 on account of a manufacturing process, which causes the roller-rotation restraining part 180 to be constituted by a pair of left and right plates which are separated from each other. In this case, when a plurality of caps 170 are fed out from a supplying feeder during the manufacturing process of the caps 170, a cap 170 may be inserted into another cap 170 through its assembling slot 175, so that they may be tangled with each other, which can be a primary factor reducing a production efficiency in the manufacturing process of the caps 170.

That is, since the cap 170 is made of a thin metal plate, a portion of the thin metal plate is inserted through the assembling slot 175 of another cap 170, so that they may be tangled with each other.

Accordingly, in order to solve the aforementioned problem, a protrusion and an inserting recess for closing the assembling slot may be formed at the end of the roller-rotation restraining part.

Figure 6:
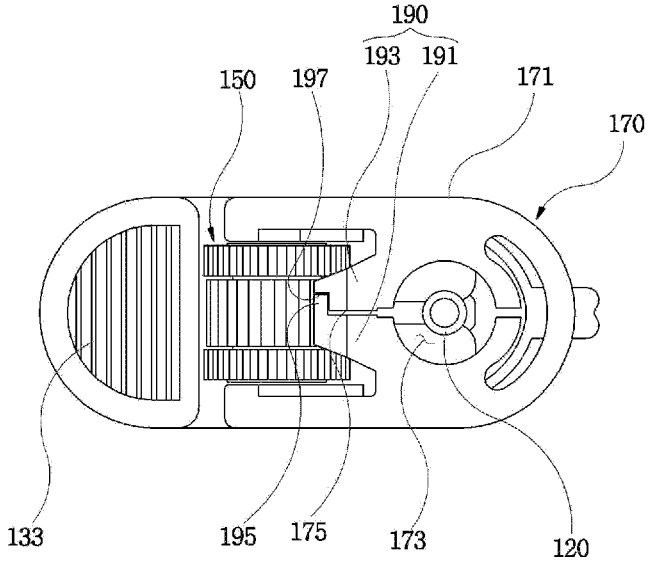
FIG. 6 is a plan view illustrating another embodiment of the roller-rotation restraining part, which is formed with a protrusion and an insertion slot for closing an assembling slot.

FIG. 6 is a plan view illustrating another embodiment of the roller-rotation restraining part, which is provided with a protrusion and an insertion slot for closing an assembling slot.

The roller-rotation restraining part 190 of the embodiment shown in FIG. 6 includes a pair of left and right plates 191 and 193, wherein one plate 191 has a protrusion 195 at an end thereof, which protrudes toward the other plate 193, and the other plate 193 has an inserting recess 197 at an end thereof, into which the protrusion 195 is inserted, so that the protrusion 195 is inserted into and coupled to the inserting recess 197, thereby closing the assembling slot 175 formed between the pair of plates 191 and 193.

With such a configuration, when the plurality of caps 170 are fed out from a supplying feeder during the manufacturing process of the caps 170, a cap 170 can be prevented from being inserted into another cap 170 through its assembling slot 175, so that they may be prevented from being tangled with each other.

As such, the production efficiency in the manufacturing process of the cap 170 can be improved by closing the assembling slot 175 formed on the cap 170.

Hereinafter, a state where the gas lighter with the roller-rotation restraining part according to the first embodiment of the present invention as constructed above is used will be described.

Figure 7:
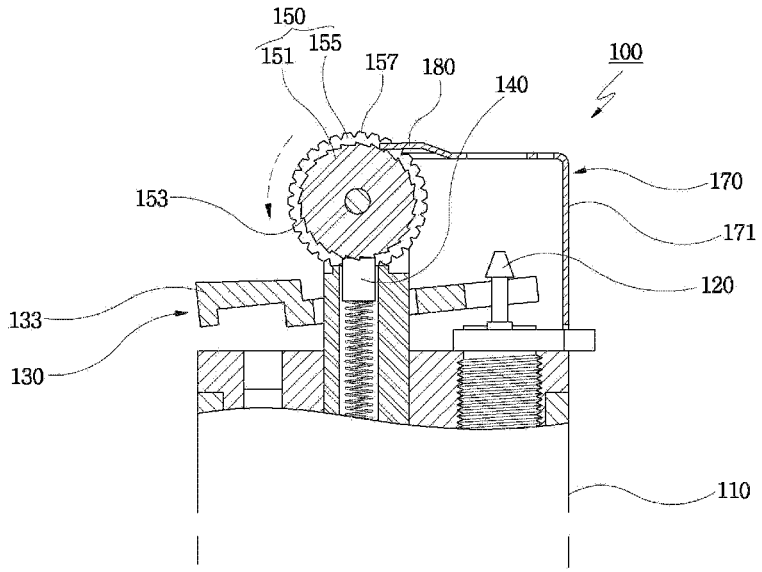
FIG. 7 shows a state where the gas lighter with the roller-rotation restraining part according to the first embodiment of the present invention is used.
Figure 7:
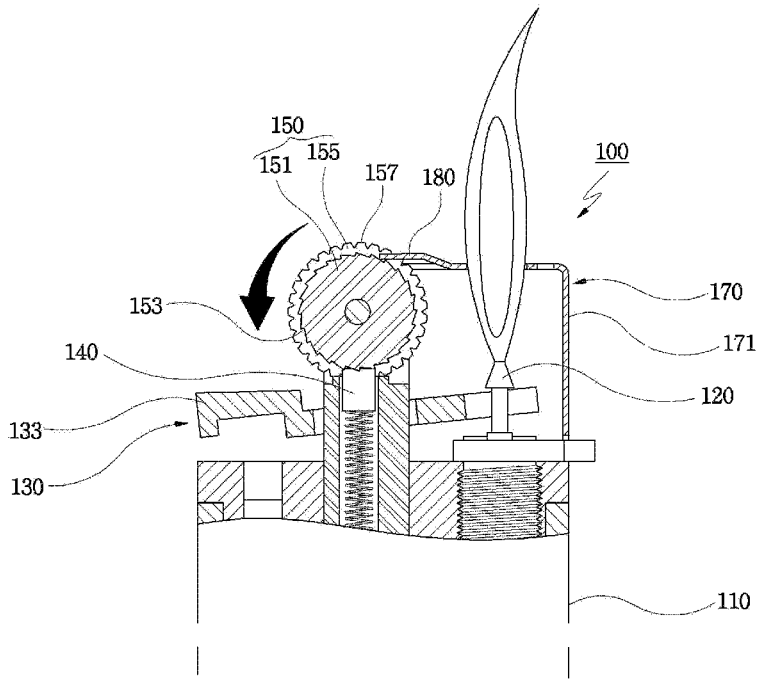

FIG. 7 shows a state where the gas lighter with the roller-rotation restraining part according to the first embodiment of the present invention is used.

As shown in FIG. 7(*a*), in order to ignite the gas lighter, the roller 150 should be rotated by bringing a finger in close contact with the side wheels 155 of the roller 150 and then applying a force thereto, wherein if the force applied to the side wheels 155 is not larger than a predetermined amount, the gas lighter cannot be ignited.

That is, if the user rotates the side wheels 155, the spark wheel 151 provided between the pair of side wheels 155 is rotated so that the roller-rotation restraining part 180 which is caught to and brought in contact with the groove 153 of the spark wheel 151 adds a certain rotation-restraining force to the rotation of the spark wheel 151, thereby restraining the rotation of the roller 150.

Accordingly, since the roller-rotation restraining part 180 is caught to and brought in close contact with the groove 153 of the spark wheel 151, a force larger than the rotation-restraining force acting on the roller 150 should be applied to rotate the roller 150. As such, an adult having a relatively larger finger grasp force can rotate the roller 150 in a relatively easy manner, while a child having a relatively smaller finger grasp force than an adult cannot rotate the roller 150.

As shown in FIG. 7(*b*), as an adult uses the gas lighter, since the roller-rotation restraining part 180 is caught to and brought in close contact with the groove 153 of the spark wheel 151, if a force larger than the rotation-restraining force acting on the roller 150 is applied to the side wheels 155 of the roller 150, the side wheels 155 may be rotated over the rotation-restraining force and thus the spark wheel 151 provided between the pair of side wheels 155 may also be rotated, so that the spark wheel 151 is rubbed with the lighter flint 140 to generate a spark required to ignite the gas lighter. Simultaneously, the push plate 133 of the lever 130 is pushed down, so that a gas is sprayed from the nozzle 120, thereby resulting in ignition due to the spark.

Meanwhile, rather than the component which is in contact with the spark wheel to restrain the spark wheel from being rotated, a gas lighter with a roller-rotation restraining part according to the present invention may be configured to have a component which is in contact with the pair of side wheels formed on both sides of the spark wheel to restrain the side wheels from being rotated to add a certain rotation-restraining force to the roller. Hereinafter, a second embodiment of the present invention so constructed will be described in detail with reference to the drawings.

Figure 8:
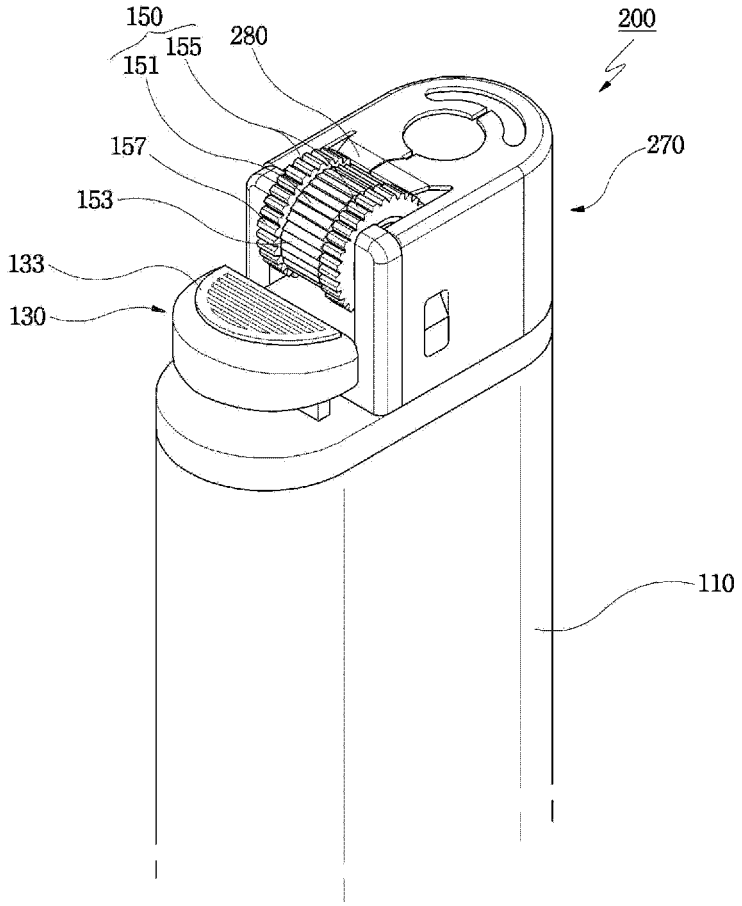
FIGS. 8 and 9 are views illustrating a gas lighter with a roller-rotation restraining part according to a second embodiment of the present invention.
Figure 9:
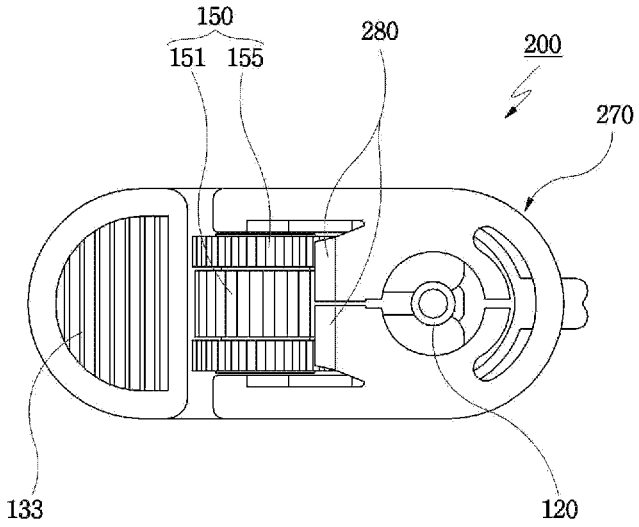

FIGS. 8 and 9 are views illustrating a gas lighter with a roller-rotation restraining part according to the second embodiment of the present invention.

As shown in FIGS. 8 and 9, according to a gas lighter 200 with a roller-rotation restraining part according to the second embodiment of the present invention, a roller-rotation restraining part 280 of a cap 270 is configured to have a width corresponding to that of the roller 150 and extends to be bent toward the top surface of the roller 150, so that a distal end of the roller-rotation restraining part is caught to and brought in contact with a concavity between two adjacent operating saw teeth 157 of the pair of side wheels 155.

The distal end of the roller-rotation restraining part 280 as formed above is configured to be caught by the operating saw teeth 157 of the pair side wheel 155, so that the distal end cannot be in contact with the spark wheel 151 having a diameter smaller than those of the side wheels 155.

With such a configuration, if the user rotates the pair of side wheels 155 to ignite the gas lighter, the pair of side wheels 155 are rotated with the roller-rotation restraining part 280 being caught by and brought in contact with the concavity between the two adjacent operating saw teeth 157 of each side wheel 155, so that the roller-rotation restraining part 280 causes a constant rotation restraining force to act on the pair of side wheels 155, thereby interrupting the rotation of the roller 150.

At this time, since the roller-rotation restraining part 280 is caught by and brought in close contact with the concavity between the two adjacent operating saw teeth 157 of each side wheel 155, if a force larger than the rotation-restraining force acting on the roller 150 is applied to the side wheels 155 of the roller 150, the side wheels 155 are rotated over the rotation-restraining force and thus the spark wheel 151 provided between the pair of side wheels 155 is also rotated, so that the spark wheel 151 is rubbed with the lighter flint 140 (see FIG. 4) to generate a spark required for ignition. Simultaneously, the push plate 133 of the lever 130 is pushed down, so that a gas is sprayed from the nozzle 120, thereby resulting in ignition due to the spark.

At this time, since the roller-rotation restraining part 280 is caught to and brought in close contact with the concavity between the two adjacent operating sawteeth 157 of each side wheel 155, if a force larger than the rotation-restraining force acting on the roller 150 is applied to the side wheels 155 of the roller 150, the side wheels 155 is rotated over the rotation-restraining force and thus the spark wheel 151 provided between the pair of side wheels 155 is also rotated, so that the spark wheel 151 is rubbed with the lighter flint 140 (see FIG. 4) to generate a spark required for ignition. Simultaneously, the push plate 133 of the lever 130 is pushed down, so that a gas is be sprayed from the nozzle 120, thereby resulting in ignition due to the spark.

The aforementioned configuration of the second embodiment of the present invention may be usefully applied when the rotation of the spark wheel cannot be easily restrained with the configuration of the first embodiment as described above, in particular, when the grooves formed on the spark wheel has a substantially shallow depth, the grooves are formed in an irregular pattern, and the like.

In addition, if the rotation-restraining force acting on the roller is required to be more reinforced, a gas lighter with a roller-rotation restraining part according to the present invention may be configured as will be described in the third embodiment in which the roller-rotation restraining part provided in the cap is simultaneously caught to and brought in contact with the pair of side wheels of the roller as well as the spark wheel of the roller spark.

Figure 10:
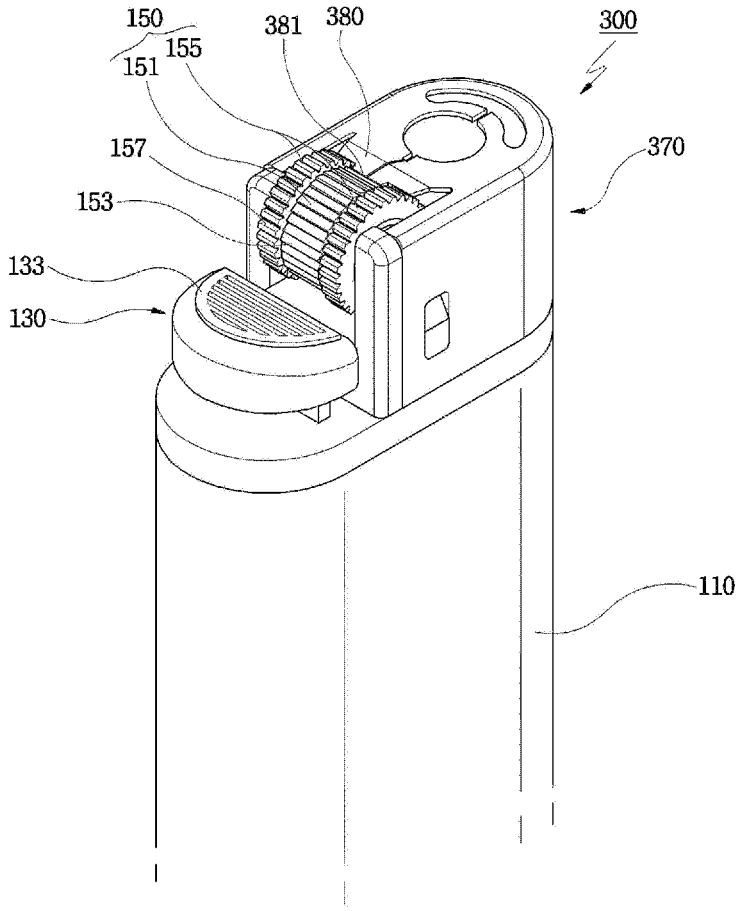
FIGS. 10 and 11 are views illustrating a gas lighter with a roller-rotation restraining part according to a third embodiment of the present invention.
Figure 11:
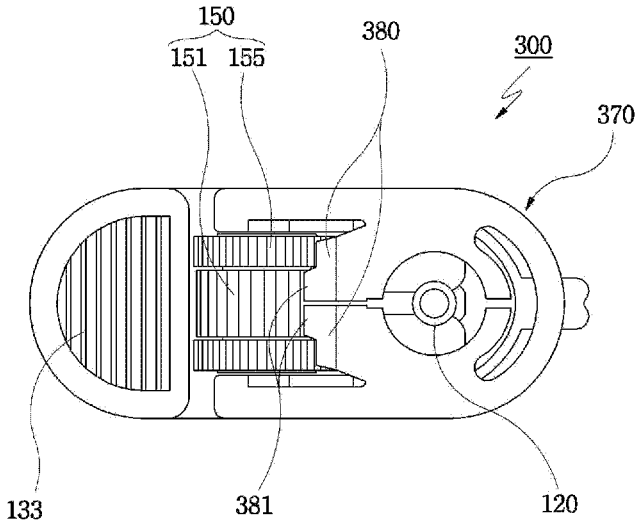

FIGS. 10 and 11 are views illustrating a gas lighter with a roller-rotation restraining part according to the third embodiment of the present invention.

As shown in FIGS. 10 and 11, a gas lighter 300 with a roller-rotation restraining part according to the third embodiment of the present invention has, in addition to the roller-rotation restraining part 280 (see FIG. 9) of the second embodiment as described above, a secondary restraining part 381, which is caught to and brought in contact with the groove 153 of the spark wheel 151, additionally formed to protrude at a central portion of the roller-rotation restraining part 380.

That is, in this embodiment, a roller-rotation restraining part 380 of a cap 370 is formed to have a width corresponding to that of the roller 150 and extends to be bent toward the top surface of the roller 150, so that both distal ends of the roller-rotation restraining part 380 are caught to and brought in contact with the saw teeth 157 of the pair of side wheels 155, while the roller-rotation restraining part 380 has a secondary restraining part 381 at a central portion thereof, wherein a distal end of the secondary restraining part 381 which extends and protrudes from the roller-rotation restraining part 380 is caught to and brought in contact with the groove 153 formed on the spark wheel 151.

With such a configuration, when the user rotates the pair of side wheels 155 to ignite the gas lighter, the pair of side wheels 155 are rotated with the roller-rotation restraining part 380 being caught by and brought in contact with the concavity between the two adjacent operating saw teeth 157 of each side wheel 155, so that a rotation restraining force is exerted on the pair of side wheels 155. Simultaneously, while the spark wheel 151 provided between the pair of side wheels 155 is rotated, the secondary restraining part 381 which is caught by and brought in contact with the groove 153 of the spark wheel 151 also causes a rotation restraining force to act on the spark wheel 151, thereby further reinforcing the rotation-restraining force acted on the roller.

That is, the gas lighter 300 with the roller-rotation restraining part according to the third embodiment causes a rotation restraining force to act on the pair of side wheels 155 by the roller-rotation restraining part 380 and simultaneously causes a rotation restraining force to act on the spark wheel 151 by the secondary restraining part 381 which is formed to protrude from the distal end of the roller-rotation restraining part 380, so that a more reinforced rotation-restraining force is exerted on the rotation of the roller 150 as compared with the gas lighters 100 and 200 according to the first and second embodiments as described above. As such, even when the gas lighter is used for a long time, the rigidity of the roller-rotation restraining part 380 may be maintained for a long time, so that sufficient rotation-restraining force can be provided to the roller.

Meanwhile, similar to the embodiment shown in FIG. 6, there is no doubt that the protrusion and the inserting recess for closing the assembling slot of the roller-rotation restraining part may be formed when the caps 270 and 370 according to the second and third embodiments as described above are manufactured.

As described above, the gas lighter according to the present invention has the roller-rotation restraining part at the cap of the gas lighter which is caught to and brought in contact with the roller. Accordingly, the certain rotation-restraining force are added to the rotation of the roller by means of the roller-rotation restraining part which is caught to and brought in contact with the roller during the rotation of the roller for ignition, thereby increasing the finger grasp force required for the ignition of the gas lighter through the rotation of the roller. As such, it is substantially difficult for a child having a relatively smaller finger grasp force than an adult to ignite the gas lighter, thereby being capable of protect children from fire hazards due to the gas lighter.

The present invention is not limited to the aforementioned embodiments and the accompanying drawings since those skilled in the art can make various substitutions and modifications thereto without departing from the technical spirit of the invention.

What is claimed is:

1. A gas lighter with a roller-rotation restraining part, comprising:

a tank for storing a gas;

a nozzle for emitting the gas stored in the tank;

a lever for opening and closing the nozzle;

a lighter flint disposed adjacent to the nozzle;

a roller comprising a spark wheel and a pair of side wheels, the spark wheel being engageable with the lighter flint to cause the gas emitted from the nozzle to be ignited, a side wheel being disposed on each sides of the spark wheel, respectively, the side wheels having a plurality of operating saw teeth formed around an outer peripheral surfaces thereof; and a cap surrounding the nozzle, the cap being formed with an upper surface defining a flame discharge hole through which an ignited flame is discharged, wherein protrusions on the upper surface of the cap extend from the flame discharge hole to define a roller-rotation restraining part, the roller-rotation restraining part comprising an extension of the upper surface of the cap and being disposed at an angle toward and contacting a corrugated surface of the roller, so that a distal end of the roller-rotation restraining part extension is caught by and disposed in substantially continuous contact against the roller, thereby imposing a substantially continuous rotation-restraining force on the roller during the rotation of the roller for ignition of the gas emitted from the nozzle.

2. The gas lighter as claimed in claim 1, wherein a plurality of grooves are formed on an outer peripheral surface of the spark wheel, and the extension of the roller-rotation restraining part is formed to have a width corresponding to that of the spark wheel, whereby the distal end of the roller-rotation restraining part extension is caught by and brought in substantially continuous contact with the grooves formed on the spark wheel.

3. The gas lighter as claimed in claim 1, wherein the extension of the roller-rotation restraining part is formed to have a width corresponding to that of the roller, whereby the distal end of the roller-rotation restraining part extension is caught by and brought in substantially continuous contact with a concavity between the operating saw teeth of the pair of side wheels.

4. The gas lighter as claimed in claim 3, wherein a plurality of grooves are formed on the outer peripheral surface of the spark wheel, and the roller-rotation restraining part further comprising a secondary restraining part formed at a central portion thereof, the secondary restraining part comprising a second extension of the upper surface of the cap, said second extension defining a protrusion at its distal end having a width corresponding to that of the spark wheel, whereby the protruding distal end of the second extension of the upper surface of the cap is caught by and disposed in substantially continuous contact against one of the grooves formed on the spark wheel.

5. The gas lighter as claimed in claim 1, wherein the cap has an assembling slot formed on the top surface of the cap along a central portion from the flame discharge hole to the distal end of the roller-rotation restraining part, and the roller-rotation restraining part includes a pair of left and right plates which are separated from each other by means of the assembling slot.

6. The gas lighter as claimed in claim 5, wherein one of the pair of left and right plates constituting the roller-rotation restraining part has a protrusion at an end thereof, which protrudes toward the other plate, and the other plate has an inserting recess at an end thereof, into which the protrusion is inserted.

7. The gas lighter as claimed in claim 1, wherein the cap and the roller restraining part are made of a unitary cold-drawn steel plate.

8. The gas lighter as claimed in claim 1, wherein the distal end of the roller-rotation restraining part extension is caught by and disposed in substantially continuous contact against the roller side wheels, thereby imposing a substantially continuous rotation-restraining force on the roller during rotation of the roller during ignition of the gas emitted from the nozzle.

9. The gas lighter as claimed in claim 8, wherein the roller-rotational restraining part further comprising a further restraining part formed therein, the further restraining part comprising a further extension of the upper surface of the cap, said further extension defining a protrusion at its distal end having a width corresponding to that of the spark wheel, whereby the protruding distal end of the further protrusion of the upper surface of the cap is substantially continuously caught by and disposed in contact against the spark wheel, thereby imposing a substantially continuous rotation-resisting force on the roller during the rotation of the roller for ignition of the gas emitted from the nozzle.

* * * * *

UNITED STATES PATENT AND TRADEMARK OFFICE

CERTIFICATE OF CORRECTION

PATENT NO. : 8,840,398 B2
APPLICATION NO. : 13/366171
DATED : September 23, 2014
INVENTOR(S) : K. C. Lee It is certified that error appears in the above-identified patent and that said Letters Patent is hereby corrected as shown below:

| COLUMN | LINE | ERROR |
|---|---|---|
| 10 (Claim 1) | 25 | "on each sides" should read --on each side-- |

Signed and Sealed this
Eighth Day of December, 2015

Michelle K. Lee

Michelle K. Lee
*Director of the United States Patent and Trademark Office*